US005427070A

United States Patent [19]

Thomas et al.

[11] Patent Number: 5,427,070

[45] Date of Patent: Jun. 27, 1995

[54] METHOD OF AVERAGING COOLANT TEMPERATURE FOR AN INTERNAL COMBUSTION ENGINE

[75] Inventors: Christopher P. Thomas, Rochester Hills; Gregory T. Weber, Commerce Township; Glen E. Tallarek, Grosse Pointe Woods, all of Mich.

[73] Assignee: Chrysler Corporation, Highland Park, Mich.

[21] Appl. No.: 238,093

[22] Filed: May 4, 1994

[51] Int. Cl.[6] ..... F02M 51/00

[52] U.S. Cl. ..... 123/488

[58] Field of Search ..... 123/488, 299, 480, 478, 123/492, 493, 494, 476; 364/431.05, 431.11, 571.03, 557; 374/133, 144

[56] References Cited

U.S. PATENT DOCUMENTS

| | | | |
|---|---|---|---|
| 5,001,656 | 3/1991 | Zimmerman et al. | 364/557 |
| 5,003,944 | 4/1991 | Moote et al. | 123/299 |
| 5,003,952 | 4/1991 | Weglarz et al. | 123/478 |
| 5,003,953 | 4/1991 | Weglarz et al. | 123/478 |
| 5,022,373 | 6/1991 | Kobayashi et al. | 123/488 |
| 5,040,513 | 8/1991 | Schnaibel et al. | 123/488 |
| 5,101,795 | 4/1992 | Hirschmann et al. | 123/488 |
| 5,113,827 | 5/1992 | Vincent | 123/417 |
| 5,159,914 | 11/1992 | Follmer et al. | 123/494 |
| 5,197,433 | 3/1993 | Dykstra et al. | 123/52 MB |
| 5,235,946 | 8/1993 | Fodale et al. | 123/339 |

*Primary Examiner*—Raymond A. Nelli

*Attorney, Agent, or Firm*—Mark P. Calcaterra

[57] ABSTRACT

A method of averaging coolant temperature for an internal combustion engine in an automotive vehicle includes the steps of sensing coolant temperature of the engine based on an output signal of a coolant temperature sensor, determining an initial value of coolant temperature based on the output signal from the coolant temperature sensor, storing the determined initial value as an initial coolant temperature value (CLTMP1) and as an averaged coolant temperature value (AVCT), periodically updating the AVCT value, and using the AVCT value to control the output of fuel injectors of the engine.

6 Claims, 1 Drawing Sheet

METHOD OF AVERAGING COOLANT TEMPERATURE FOR AN INTERNAL COMBUSTION ENGINE

BACKGROUND OF THE INVENTION

1. Field of the Invention

The present invention relates generally to internal combustion engines for automotive vehicles and, more particularly, to a method of averaging coolant temperature for an internal combustion engine in an automotive vehicle.

2. Description of the Related Art

Today in automotive vehicles, some automotive vehicle manufacturers use "port-injected" internal combustion engines in their vehicles. In the port-injected engine, a fuel injector sprays fuel into air in an intake manifold of the engine near an intake valve of a cylinder of the engine as the air gets pulled into the cylinder during the cylinder's intake stroke. A problem with fuel delivery in all engines is that some of the fuel remains suspended in charge air or adheres to walls of the intake manifold (i.e., "wall wetting"). The amount of fuel that ends up adhering to the manifold walls is partly a function of engine rotational speed, manifold pressure, and manifold wall temperature. The amount of fuel on the manifold walls changes as the engine operational mode changes which, in turn, causes a fuel/air ratio of the charge mixture to vary as it is inducted into the cylinder of the engine.

For optimal engine performance, it is necessary for the fuel control system to compensate for this variation in the fuel/air ratio (e.g., deliver less fuel when fuel is being liberated from the manifold walls and vice versa). This compensation is accomplished by monitoring parameters that affect how much fuel will be added to or liberated from the manifold walls and adjusting a pulse-width of the fuel injector accordingly. Whereas engine rotational speed and manifold pressure are both easy to sense and calculate, manifold wall temperature is not easy to sense and calculate because there is no sensor measuring its temperature.

One attempt to deduce the manifold wall temperature was based on engine coolant temperature which provided a coarse approximation. This coarse approximation had some drawbacks that prevented accurate fuel control during a warm-up period of the engine. The first drawback was that the engine coolant tended to warm up more rapidly than the material of the intake manifold. The second drawback occurred when a thermostat opened allowing the engine coolant temperature to "dip" with the in-rush of cold engine coolant.

SUMMARY OF THE INVENTION

It is, therefore, one object of the present invention to provide a method of approximating wall temperature of an intake manifold for an internal combustion engine.

It is another object of the present invention to provide a method of averaging coolant temperature of an internal combustion engine in an automotive vehicle.

It is a further object of the present invention to provide a method of averaging coolant temperature to yield a better approximation of intake manifold wall temperature without adding the cost of a separate charge temperature sensor.

To achieve the foregoing objects, the present invention is a method of averaging coolant temperature for an internal combustion engine in an automotive vehicle.

The method includes the steps of sensing coolant temperature of the engine based on an output signal of a coolant temperature sensor and determining an initial value of coolant temperature based on the output signal from the coolant temperature sensor. The method also includes the steps of storing the determined initial value as an initial coolant temperature value (CLTMP1) and as an averaged coolant temperature value (AVCT), periodically updating the AVCT value and using the AVCT value to control the output of fuel injectors of the engine.

One advantage of the present invention is that a method of averaging coolant temperature for an internal combustion engine in an automotive vehicle is provided. Another advantage of the present invention is that the method of averaging coolant temperature yields a better approximation of the wall temperature of the intake manifold. Yet another advantage of the present invention is that the method provides a more accurate prediction/approximation of the manifold wall temperature by performing a time based averaging of the engine coolant temperature. A further advantage of the present invention is that the method of averaging coolant temperature is less expensive than the additional cost of a separate charge temperature sensor.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
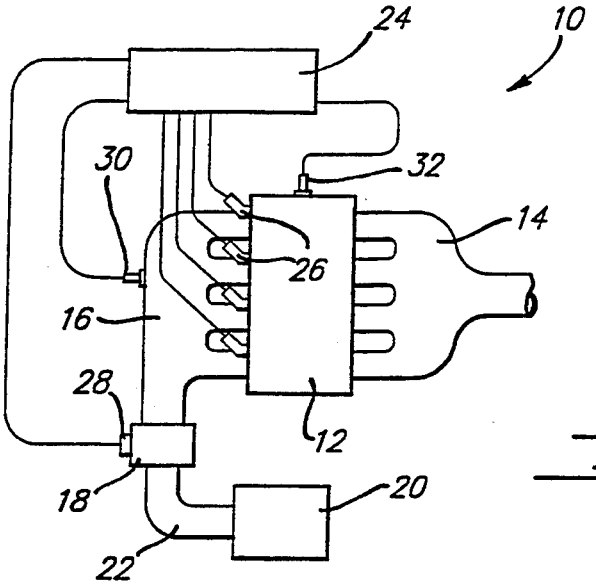
FIG. 1 is a schematic diagram of an electronic fuel injection system illustrated in operational relationship with an internal combustion engine of an automotive vehicle.

Referring to FIG. 1, an electronic fuel injection system 10, according to the present invention, is illustrated in operational relationship with an internal combustion engine 12 of an automotive vehicle (not shown). The engine 12 includes an exhaust manifold 14 connected to cylinders (not shown) of the engine 12. The engine 12 also includes an intake manifold 16 connected thereto and a throttle body 18 connected to the intake manifold 16. The engine 12 further include an air filter 20 connected by a conduit 22 to the throttle body 18. It should be appreciated that the engine 12 is conventional and known in the art.

The electronic fuel injection system 10 includes an engine controller 24 having fuel injector outputs 26 connected to corresponding fuel injectors (not shown) of the engine 12 which meter an amount of fuel to the cylinders of the engine 12. The electronic fuel injection system 10 also includes a throttle position sensor 28 connected to the throttle body 18 and the engine controller 24 to sense an angular position of a throttle plate (not shown) in the throttle body 18. The electronic fuel injection system 10 includes a manifold absolute pressure (MAP) sensor 30 connected to the intake manifold 16 and the engine controller 24 to sense MAP. The electronic fuel injection system 10 also includes a coolant temperature sensor 32 connected to the engine 12 and the engine controller 24 to sense a temperature of the engine 12. It should be appreciated that the engine controller 24 and sensors 28,30 and 32 are conventional and known in the art.

Figure 2:
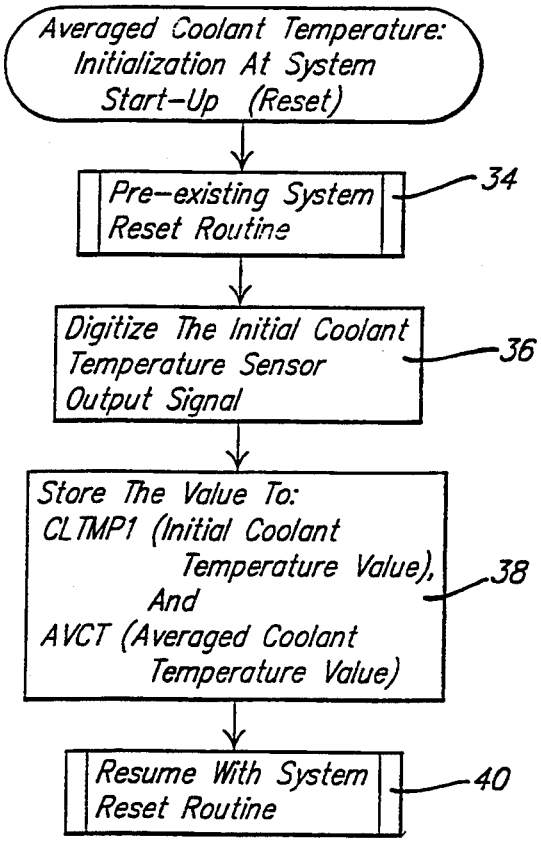
FIGS. 2 and 3 are flowcharts of a method of averaging coolant temperature, according to the present invention for the electronic fuel injection system and internal combustion engine of FIG. 1.
Figure 3:
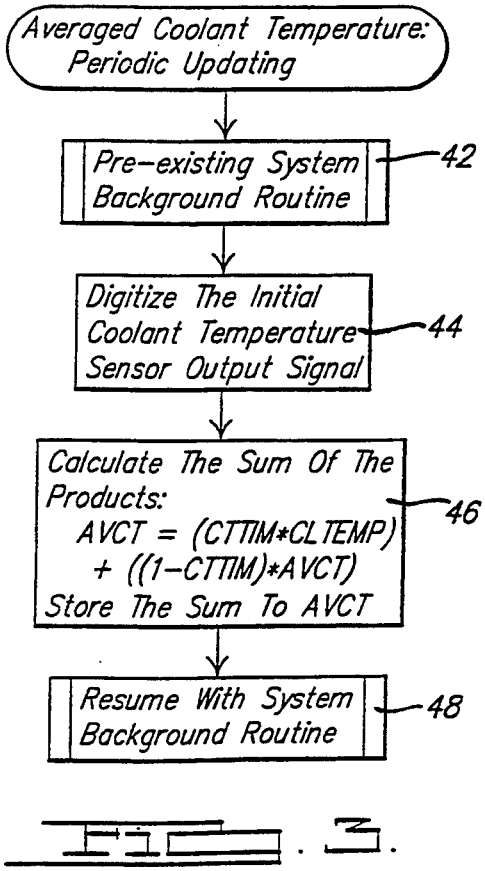

Referring to FIGS. 2 and 3, a method of averaging coolant temperature, according to the present invention, for the electronic fuel injection system 10 and engine 12 is shown. As illustrated in FIG. 2, an initialization portion of the methodology is shown. The methodology begins in block 34 at start-up (reset) of the electronic fuel injection system 10. The methodology advances to block 36 and digitizes the initial output signal from the coolant temperature sensor 32. The controller 24 determines the digitized initial coolant temperature value from the coolant temperature sensor 32. The methodology advances to block 38 and stores the initial coolant temperature value in memory of the controller 24 to two separate RAM locations labeled CLTMP1 (initial coolant temperature value) and AVCT (averaged coolant temperature value). The CLTMP1 value remains unchanged thereafter for the duration of the "trip" (e.g., until the engine 12 is restarted) and is used as a reference for other routines of the controller 24 that are based on the initial coolant temperature value. The AVCT value is updated as described below and is used as an approximation of the intake manifold wall temperature. From block 38, the methodology then advances to block 40 and resumes with the reset routine of the electronic fuel injection system 10.

As illustrated in FIG. 3, a periodic updating portion of the methodology is shown. The methodology begins in block 42 with a pre-existing background routine. The periodic updating of the AVCT value is done once during the "background" control loop of the electronic fuel injection system 10 which has a predetermined, fixed period (e.g., 2.752 seconds). From block 42, the methodology advances to block 44 and digitizes the initial output signal from the coolant temperature sensor 32, as previously described, to determine an initial coolant temperature value. The digitized initial coolant temperature value is stored to a RAM location labeled CLTEMP (coolant temperature). The methodology advances to block 46 and calculates the AVCT. The controller 24 calculates a coolant temperature time averaging factor from a two-dimensional calibration table stored in memory of the controller 24 using CLTMP1 as an independent look-up parameter. The coolant temperature time averaging factor is stored in a RAM location in memory of the controller 24 labeled CTTIM. This CTTIM is kept constant for the duration of the "trip" and ranges in value from 0.00 (0%) to 1.00 (100%). Then the AVCT value is updated using CTTIM according to the following equation:

$$AVCT_{NEW}=(CTTIM * CLTEMP)+((1-CTTIM) * AVCT_{OLD})$$

The controller 24 then stores the $AVCT_{NEW}$ value to the RAM location AVCT in memory of the controller 24. From block 46, the methodology advances to block 48 and resumes with the "background" control loop or routine of the electronic fuel injection system 10. The AVCT value is used by the controller 24 to control the output of the fuel injectors by adjusting the pulsewidth thereof. It should be appreciated that the AVCT value will be used as an approximation of the wall temperature of the intake manifold 16 for adjusting the pulsewidth of the fuel injectors of the engine 12.

Accordingly, the method provides a more accurate prediction/approximation of the wall temperature of the intake manifold by doing a time based averaging of the engine coolant temperature. This "averaged coolant temperature" takes into account the heat transfer properties from the engine block and cooling system to the intake manifold. The method helps overcome fueling problems during engine acceleration and deceleration (transient) conditions.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of averaging coolant temperature for an internal combustion engine in an automotive vehicle, said method comprising the steps of:

sensing coolant temperature of the engine based on an output signal of a coolant temperature sensor;

determining an initial value of coolant temperature based on the output signal from the coolant temperature sensor;

storing the determined initial value as an initial coolant temperature value (CLTMP1) and as an averaged coolant temperature value (AVCT);

periodically updating the AVCT value; and using the AVCT value to control the output of fuel injectors of the engine.

2. A method as set forth in claim 1 wherein said step of periodically updating comprises digitizing the output signal from the coolant temperature sensor and determining the coolant temperature (CLTEMP).

3. A method as set forth in claim 2 wherein said step of periodically updating further comprises calculating a new AVCT value based on CLTEMP.

4. A method as set forth in claim 3 including the step of updating the AVCT value as the calculated AVCT value.

5. A method as set forth in claim 1 wherein said step of determining includes digitizing the output signal from the coolant temperature sensor.

6. A method of averaging coolant temperature for an internal combustion engine in an automotive vehicle, said method comprising the steps of:

sensing coolant temperature of the engine based on an output signal of a coolant temperature sensor;

determining an initial value of coolant temperature based on the output signal from the coolant temperature sensor;

storing the determined initial value as an initial coolant temperature value (CLTMP1) and as an averaged coolant temperature value (AVCT);

periodically updating the AVCT value;

using the AVCT value to control the output of fuel injectors of the engine;

said step of periodically updating comprises digitizing the output signal from the coolant temperature sensor and determining the coolant temperature (CLTEMP);

said step of periodically updating further comprises calculating a new AVCT value based on CLTEMP;

the step of updating the AVCT value as the calculated AVCT value; and said step of determining includes digitizing the output signal from the coolant temperature sensor.

* * * * *